US007111647B2

(12) United States Patent
Debaes

(10) Patent No.: US 7,111,647 B2
(45) Date of Patent: Sep. 26, 2006

(54) WEAVING MACHINE AND METHOD FOR WEAVING PILE FABRICS AND SPACER FOR SUCH A WEAVING MACHINE

(75) Inventor: Johny Debaes, Moorslede (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 11/065,295

(22) Filed: Feb. 25, 2005

(65) Prior Publication Data

US 2005/0183787 A1 Aug. 25, 2005

(30) Foreign Application Priority Data

Feb. 25, 2004 (BE) ..... 2004/0107
Jun. 28, 2004 (BE) ..... 2004/0319

(51) Int. Cl.
*D03D 39/16* (2006.01)

(52) U.S. Cl. ..... 139/21; 139/37; 139/38; 139/40; 139/41

(58) Field of Classification Search ..... 139/21, 139/37, 38, 40, 41
See application file for complete search history.

(56) References Cited

U.S. PATENT DOCUMENTS 3,289,706 A 12/1966 Valentine
5,154,208 A * 10/1992 Carlos ..... 139/37
5,615,712 A * 4/1997 Derudder et al. ..... 139/21
6,186,189 B1 * 2/2001 Gheysen ..... 139/392
6,817,383 B1 * 11/2004 Debaes et al. ..... 139/21
6,837,274 B1 * 1/2005 Debaes et al. ..... 139/21

FOREIGN PATENT DOCUMENTS

EP 1347067 9/2003
EP 1375715 1/2004
JP 53/147859 12/1978

* cited by examiner

*Primary Examiner*—John J. Calvert
*Assistant Examiner*—Robert H. Muromoto
(74) *Attorney, Agent, or Firm*—James Creighton Wray

(57) ABSTRACT

A weaving machine weaves pile fabrics having weft yarns, backing warp yarns, and pile warp yarns. One or several spacers extend between the pile warp yarns either to realize a constant pile height between two pile fabrics formed, or to determine the pile loop height in one or several pile fabrics comprising pile loops. One or several holders clamp the spacers. One or several shed forming devices, drive heddles through which backing and/or pile warp yarns extend to position these warp yarns with respect to the weft yarns. A zone for supplying pile warp yarns extends between a yam supply and the heddles. One or several holders installed between the yarn supply and the one or several shed forming devices clamp the spacers. The holders are installed outside the said supply zone, in such a manner that the pile warp yarns will extend into the supply zone without any hindrance.

31 Claims, 6 Drawing Sheets

WEAVING MACHINE AND METHOD FOR WEAVING PILE FABRICS AND SPACER FOR SUCH A WEAVING MACHINE

This application claims the benefit of Belgian Application No. 2004/0107 filed Feb. 25, 2004 and Belgian Application No. 2004/0319 filed Jun. 28, 2004 which are hereby incorporated by reference in their entirety.

BACKGROUND OF THE INVENTION

The invention firstly relates to a weaving machine for weaving pile fabrics consisting of weft yarns, backing warp yarns and pile warp yarns comprising:

- one or several spacers extending between the pile warp yarns and which are provided either to realize a constant pile height between two pile fabrics formed, or to determine the pile loop height in one or several pile fabrics comprising pile loops;
- one or several holders for clamping the spacers;
- one or several shed forming devices, driving heddles through which backing and/or pile warp yarns extend in order to position these warp yarns with respect to the weft yarns;
- a yarn supply;

a zone for supplying pile warp yarns extending between the yarn supply and the heddles controlled by the shed forming device, and one or several holders being installed between the yarn supply and the one or several shed forming devices in order to clamp the spacers.

Secondly, the invention relates to a method for weaving such pile fabrics.

Thirdly, the invention relates to a spacer for such a weaving machine.

When weaving pile fabrics, most of the time, lancets are used as spacers. These spacers are used for the following functions:

- to keep the fabrics formed at a distance in order to realize a uniform pile height. For a long period already, this technique is used for weaving face-to-face on face-to-face weaving machines with one single lancet for each reed dent or for each warp system;
- to determine the loop height in a loop fabric. With this technique the backing fabric is formed on the one side (upper or lower side) of the spacer, and a pile yarn is laid around an additional weft, forming a loop, which most of the time is provided to be removed from the fabric later on, when this part of the fabric has left the spacer. Such a weft yarn is called a lost pile loop weft yarn. This technique is used both for single fabrics, when only one fabric with pile loops is produced and for face-to-face weaving, where one or two sets of spacers are used and two fabrics with pile loops are produced at the same time.

In EP 1 347 087 a device and a method are described to weave two fabrics with pile loops at a time on a face-to-face weaving machine by using upper and lower spacers (lancets), a weft insertion device being provided in order to insert weft yarns between the upper and lower spacer. These spacers are comprising at least two parts, the first parts of which are extending between the upper and the lower ruler. These parts are situated at a short distance from one another and each of them is serving to determine the loop height of the pile loops of the upper and the lower fabric respectively. Furthermore, these spacers have second parts situated at a greater distance from one another. To that effect, the spacers have been buckled between the first and second parts. In this manner it has been made possible that one of the weft insertion means will be able to move between the spacers in order to insert a weft yarn. The spacers have a back part taken up in the holder. In one of the preferred embodiments of the invention described in EP 1 347 087 this spacer is represented as used in practice, i.e. a compact holder clamping the back parts of both the upper and the lower spacer, this holder being connected to the frame of the machine.

Also with face-to-face weaving techniques using one single set of spacers for weaving fabrics with a cut pile and with weaving techniques for single fabrics for weaving pile loop fabrics, the extremities of the spacers of the single set of spacers at the far side of the weaver, are taken up by a similar holder.

When weaving pile fabrics, the warp yarns are supplied from the rear of the weaving machine and they are brought into the right position by the shed forming elements in order to realize the shed necessary to obtain the pattern desired for the backing and pile fabrics. In the shed, the backing warp yarns (binding and tension warp yarns) to form the backing fabric for the upper and lower fabrics are brought into their requested position in accordance with the weave structure desired by means of heddle frames moving up and down, comprising a set of heddles which are distributed right across the width of the weaving machine. Each heddle being provided with a heddle eye, through which a backing warp yarn is conducted. The backing warp yarns are supplied from one or several backing warp beams through separating bars distributing the backing warp yarns between the upper and the lower fabric. The backing warp yarns, which are destined for the upper fabric, are conducted above the holder of the spacers to further extend through heddle eyes. The backing warp yarns for the lower fabric are conducted below the holder of the spacers before they extend through the heddle eyes.

This manner to supply the yarn will enable the backing warp yarns to obtain the position required to realize the shed which is required for the backing weave selected, without the backing warp yarns getting in touch with the holder of the spacers.

The angle formed between the direction in which the backing warp yarn is moving before and after its passage through the heddle eye may be thus kept limited, so that the force component of the stretching force in the yarn, more particularly the component to be surmounted by the weaving frame in order to move up and down the backing warp yarn will remain limited. Thus the load on the weaving frame will be restricted and operating and positioning the weaving frame will be simplified.

Pile warp yarns may be supplied from a pile warp beam in case the same amount of all the pile warp yarns situated next to one another will be used, but more often they are supplied from a weaving creel in which a bobbin spindle is provided for each pile warp yarn on which a bobbin containing the pile warp yarn having the required properties (e.g. the color) is provided. From the bobbin, the yarn is conducted through a separating grid which is situated between the weaving creel and the weaving machine and further via spindles separating the pile warp yarns in order to split up the pile warp yarns in layers per color, so that for each layer one yarn per warp system and usually also, for each layer, one yarn for each reed tooth is supplied to form the fabric in the weaving machine. The pile warp yarns being conducted through heddle eyes of heddles of either a weaving frame or a harness arrangement of a Jacquard machine. The shed forming device is controlling the movement of the heddles and therefore the position of the pile warp yarns, on the basis of data relating to the pattern to be obtained. The pile warp yarns are tensioned in the weaving creel, for instance, by applying a weight element to strain the yarn.

In weaving machine where lancets are used as spacers, because of the presence of a lancet holder on the center line of the shed, the pile warp yarns are divided into a part of the pile warp yarns being conducted through the separating spindles for the pile warp yarns which are situated above the lancet holder (for instance, for the pile warp yarns that are woven in as dead piles in the upper fabric) and into a part of the pile warp yarns being conducted through the separating spindles of the pile warp yarns situated below the lancet holder (for instance for the pile warp yarns being woven in as dead piles in the lower fabric). Separating these separating spindles for the pile warp yarns into two parts also requires an independent adjustability of the two sets of separating spindles for the pile warp yarns. Thus preventing the holders for the separating spindles for the pile warp yarns to be provided with partitions to strengthen them. Without these partitions the separating spindles for the pile warp yarns must have a considerably larger diameter in order to reduce the deflection of the separating spindles for the pile warp yarns. This larger diameter in combination with the larger number of pile warp yarns, will cause not only a layer of pile warp yarns to be running over its own separating spindle, but also that it will get in touch with another separating spindle. Because of this, the tension of the yarn will be increased, but most of all will cause problems and the risk of yarn breaks.

Because, contrary to the backing warp yarns, the pile warp yarns may be tied up around weft yarns in both the upper fabric and the lower fabric, the yarn selection positions may be further apart when the shed is formed. In case the weaving machine is equipped with lancets, it becomes difficult, if not impossible, to supply the pile warp yarns when the fabric is formed, not in a single selection position to form the shed of these pile warp yarns, these yarns may come in contact with the lancet holder. Such a contact may conduce to a greater tension to be built up and to an increased wear of the pile warp yarns. Causing an increase of the risk of yarn breakage, which may cause machine downtime and fabrics of an inferior quality. The consequences of such contacts will be an increase of the load the pile warp yarn is exerting on the heddle, because the force component in the direction of motion of the heddle will be increased. This means an increase of the load on the shed forming device and may cause an inaccurate or incorrect formation of the shed and an increased energy consumption.

A further disadvantage consists in the fact that a motion from a position in which there is a contact with the lancet holder to a position without any contact with the lancet holder, causing the yarn to be returned to the weaving creel, this returning of yarn will be greater when the pile warp yarn is in touch with the lancet holder, than when the pile warp yarn is not in touch with the lancet holder. This has a particularly harmful influence on the return springs of the harness. When returning the yarns during a downward motion, the return spring, as an element controlled in a negative sense, will be unable to follow rapidly enough to absorb this greater return of yarns to the weaving creel. This will conduce to pile warp yarns being no longer tensioned for a short period, which has an adverse effect on the weaving process. Finally, this may cause pile warp yarns and harness cords to get entangled, which finally may cause machine downtime, so that important manual interventions may be required. The resulting shock load on the return springs will cause in turn a shorter life of these return springs. These problems will become the greater as the operating speeds will be increased, the shed required to operate the machine is increasing and the number of pile warp yarns will be increased (more colors or higher densities).

In order to avoid contact between pile warp yarns and the lancet holder, it is best to bring the separating spindles for the pile warp yarns as close as possible to the fell of the fabric. However, it is a matter of course that these guiding spindles should be arranged after the heddle devices controlled by the shed forming devices for backing and pile warp yarns. However, the closer to the fell of the fabric the separating spindles for the pile warp yarns, the greater the force component of the strain in the pile warp yarn will become, the shed forming device in one of its selection positions of the shed has to overcome to bring the pile warp yarns from that position into a position required. In order to keep this force component as restricted as possible, the separating spindles for the pile warp yarns should be installed as much to the rear of the weaving machine as possible. Indeed, bringing the separating spindles for the pile warp yarns as more to the rear of the weaving machine, will lead to a contact between the pile warp yarns and the lancet holder in certain positions.

Furthermore, when weaving fabrics with a long pile where pile heights of more than 70 mm, more than 100 mm and up to over 200 mm long are realized, so-called spoon lancets are used (see publication of the Belgian patent BE 1005394 and the publication of the European patent EP 536551). These lancets have a profiled length, the height of the top part being greater than the height of the central part of the rapiers.

Up to the present, these so-called spoon lancets are taken up in one central lancet holder, having the disadvantage that these lancets, because of their weight at the top, are sagging and are difficult to install. The suspension thus obtained is rather unstable.

The purpose of the present invention is to find a solution for the above-mentioned problem, where, in a compact design, the pile warp yarns may be supplied to the zone where the shed is formed by shed forming devices, such that the load on the heddles controlled by the shed forming devices, exerted by the pile warp yarns will be kept within certain limits, and where the pile warp yarns will not come in touch, or to a lesser extent, with the holder of the spacers, and where a stable suspension and positioning of the spacers in the weaving machine will be obtained.

SUMMARY OF THE INVENTION

This purpose will be attained by providing a weaving machine for weaving pile fabrics consisting of weft yarns, backing warp yarns and pile warp yarns, comprising:

- one or several spacers, extending between the pile warp yarns and that are provided either to realize a constant pile height between two pile fabrics formed, or to determine the height of the pile loop in one or several pile fabrics comprising loop piles;
- one or several holders for the spacers to be clamped;
- one or several shed forming devices, controlling heddles through which backing and/or pile warp yarns extend in order to position these warp yarns with respect to the weft yarns;
- a yarn supply;

a supply zone for pile warp yarns extending between the yarn supply and the heddles controlled by the shed forming device, and one or several holders for the spacers to be clamped being installed between the yarn supply and one or several shed forming devices, and wherein the said holders have been installed outside the said supply zone, such that the pile warp yarns may be extending in the supply zone without hindrance.

In this manner the pile warp yarns may be supplied in the center with respect to the center line of the shed, and there will be no contact, or to a lesser extent, between the pile warp yarns and the holder of the spacers.

In a preferred embodiment of a weaving machine according to the invention, the spacers are comprising three parts:

- a first part extending near one or several rulers provided to support one or several backing fabrics;
- a second part extending near one or several rapiers provided to insert the weft yarns;
- a third part extending near the said holders, the said third part is bending off, provided to be clamped in one or several holders installed outside the supply zone.

In an advantageous embodiment of a weaving machine according to the invention, separating spindles for the pile warp yarns are provided in the weaving machine to guide the pile warp yarns, these separating spindles for the pile warp yarns being attached to one or several holders of the spacers.

Preferably, these separating spindles for the pile warp yarns are provided with partitions provided to be connected, each in turn, to one or several holders of the spacers.

This enables lighter spindles to be used, for instance with a diameter of 6 to 15 mm instead of a diameter of 30 to 40 mm and to prevent the pile warp yarns to get in touch with several separating spindles for the pile warp yarns when larger numbers of pile warp yarns are used.

In a preferred weaving machine according to the invention, one or several holders of the spacers are provided with a device in order to increase the supporting surface of the spacers taken up therein.

This has the advantage that the spacers will not tip over under the influence of their own weight and as a result of the forces exerted on these spacers during the weaving process.

Preferably, the device increasing the supporting surface of the spacers taken up in the holders is a flat plate extending across the width of the fabric towards the zone where the fabric is formed, the spacers taken up in the holder are showing an additional tooth, being provided to slide in the said flat plate.

In this manner, it will be possible to support the spacer along a greater length and to protect it against buckling. This embodiment is particularly advantageous when used in a device equipped with double spacers for face-to-face weaving of fabrics with pile loops, because in zones in the upper fabric where there are no pile loops in the fabrics in the warp direction along the length of the spacer, the spacer may be start to sag under its own weight and under the load exerted by the warp yarns being in touch with it. According to the state of the art, a stationary weaving frame is used, containing heddles with heddle eyes through which each time a spacer extends. In the preferred embodiment here described a stationary weaving frame is no longer needed. This means lower costs, a more compact machine and the elimination of wearing parts such as heddles for spacers.

Preferably, the said device is provided to be adjustable as to the supporting position of the said spacers.

Preferably, an adjusting screw and a tilting point have been provided so that the said plate may be tilted, so that this plate will push the spacers upwards or downwards respectively, depending on the direction in which the plate is moving when operating the adjusting screw.

In a preferred embodiment of a weaving machine according to the invention, the weaving machine is a face-to-face weaving machine with single spacers, the holder of the spacers being installed above the supply zone and the third parts of the spacers are bending off upwards.

The weaving machine according to the invention may likewise be a face-to-face weaving machine with single spacers where:

- either the holder of the spacers is installed below the supply zone and the third parts of the spacers are bending off downwards;
- or a first holder of the spacers is installed above the supply zone and the third parts of a first part of spacers are bending off upwards, and a second holder of the spacers being installed below the supply zone and the third parts of a second part of the spacers is bending off in the downward direction.

In case the holders of the spacers are installed as in the latter case, preferably, alternately a first spacer of the said first part of spacers bending off upwards, and a second spacer of the said second part of spacers bending off downwards are provided, bending off starting immediately outside the reach of the motion performed by the weaving reed.

This has the additional advantage that the density of the spacers at a certain height in the supply zone of the warp yarns is halved by splitting up the spacers into two heights in the zone preceding the zone of the weaving reed motion.

The weaving machine according to the invention may be a face-to-face weaving machine with three rapiers and double spacers, i.e. upper and lower spacers, the upper spacers bending off upwards in their third parts and the lower spacers bending off downwards in their third parts.

Preferably, the lower spacers, near the shed forming means of the backing warp yarns of the backing fabrics are first bending off upwards above the center line of the shed, before bending of downwards towards the holder for the spacers being situated below the supply zone of the pile warp yarns.

By which an additional problem is solved which, because the eyes of the heddles for the binding warp yarns for the lower fabric are crossing the spacers during the motion these heddles have to perform in order to form the backing fabric in order to make these binding warp yarns to support the central rapier which will have harmful consequences, i.e. an increased wearing off of the spacers and heddles, speed limits because of the heddle eyes and the spacers hitting one another, and yarn breakage provoked by the high concentration of yarns, heddle eyes and spacers. By shaping the spacers such that they will be buckling back in the upward direction, locally at the level of the shed forming means for the backing warp yarns above the center line of the shed, it will be possible again to position the heddles of the binding warp yarns of the lower backing fabric such that these binding warp yarns may serve to guide the central rapier, without the heddle eyes having to cross a spacer and because of this are no longer colliding with the spacers and no accumulation of spacers, heddle eyes, backing and pile warp yarns will be caused any longer.

In a preferred embodiment of a weaving machine according to the invention the said spacers are maintained in their operating positions by at least two holder elements, preferably by clamping.

Preferably, the said holder is comprising an upper and a lower holder element, which are installed above and below the supply zone respectively.

In a more preferred embodiment of the weaving machine according to the invention, the spacers are comprising a third part comprising at least two legs, each leg being used to be maintained in its operationing position by a different holder element.

Preferably, the legs are extending substantially parallel to one another.

Because the final part of the spacers is splitting up in two legs, which are clamped, each in a different holder element, therefore a stable suspension and positioning of the spacers in the weaving machine will be obtained.

In a more particular embodiment of the weaving machine according to the invention, the spacers are comprising a first part extending between the upper and lower cutting rulers and a second part, which extends between two different weft insertion levels of the weaving machine, both parts having a different height.

In a particularly advantageous embodiment of the weaving machine according to the invention, the edge of the upper surface of the upper holder element directed towards the yarn supply and the edge of the lower surface of the lower holder element directed towards the yarn supply have been rounded off.

Because of this, it is possible to eliminate the separating bars of the backing yarns completely, in a preferred embodiment, by having the backing warp yarns guided around the said sides rounded off.

This principle, especially providing a side rounded off on the holder elements, may likewise be applied in case only one holder is provided, outside the supply zone. Obviously this principle likewise applies in case part of the spacers are taken up in the upper holder and part of the spacers are taken up in the lower holder.

In a most particular embodiment, the said weaving machine is a face-to-face weaving machine.

Preferably, the holders of the spacers are provided to be adjustable as to their positions and in a more specific embodiment they are individually adjustable in their positions. The adjustability of their positions may refer to the holders to be adjustable as to height and to be adjustable as to their positions in the warp direction.

In a preferred embodiment the spacers are stepped, the spacers in the warp direction being displaced in a driven manner, passing from one step of the spacer to another step.

On the other hand, the purpose of the invention is attained by providing a method for weaving pile fabrics consisting of weft yarns, backing warp yarns and pile warp yarns, the method being carried out by means of a weaving machine as described above.

Another design of this invention relates to a spacer, preferably and more particularly to a spoon lancet for a weaving machine, the said spacer being provided to be maintained in its operating position by at least two holder elements.

Preferably the said spacer comprises a third part comprising at least two legs, each leg being maintained in its operating position by a different holder element.

In a preferred embodiment, the legs are extending substantially parallel to one another.

In a preferred embodiment of the spacer according to the invention, the spacer is comprising a first part and a second part having a different height.

Now, this invention will be further explained by means of the following detailed description of a preferred weaving machine and a method being used on such a weaving machine according to the invention. The purpose of this description is only to give a clarifying example and to indicate further advantages and particulars of the present invention and therefore may in no way be interpreted as a restriction of the field of application of the invention or of the patent rights demanded for in the claims.

BRIEF DESCRIPTION OF THE DRAWINGS

In this detailed description reference is made, by means of reference numbers, to the attached drawings of which.

DETAILED DESCRIPTION OF THE PREFERRED EMBODIMENTS

Figure 1:
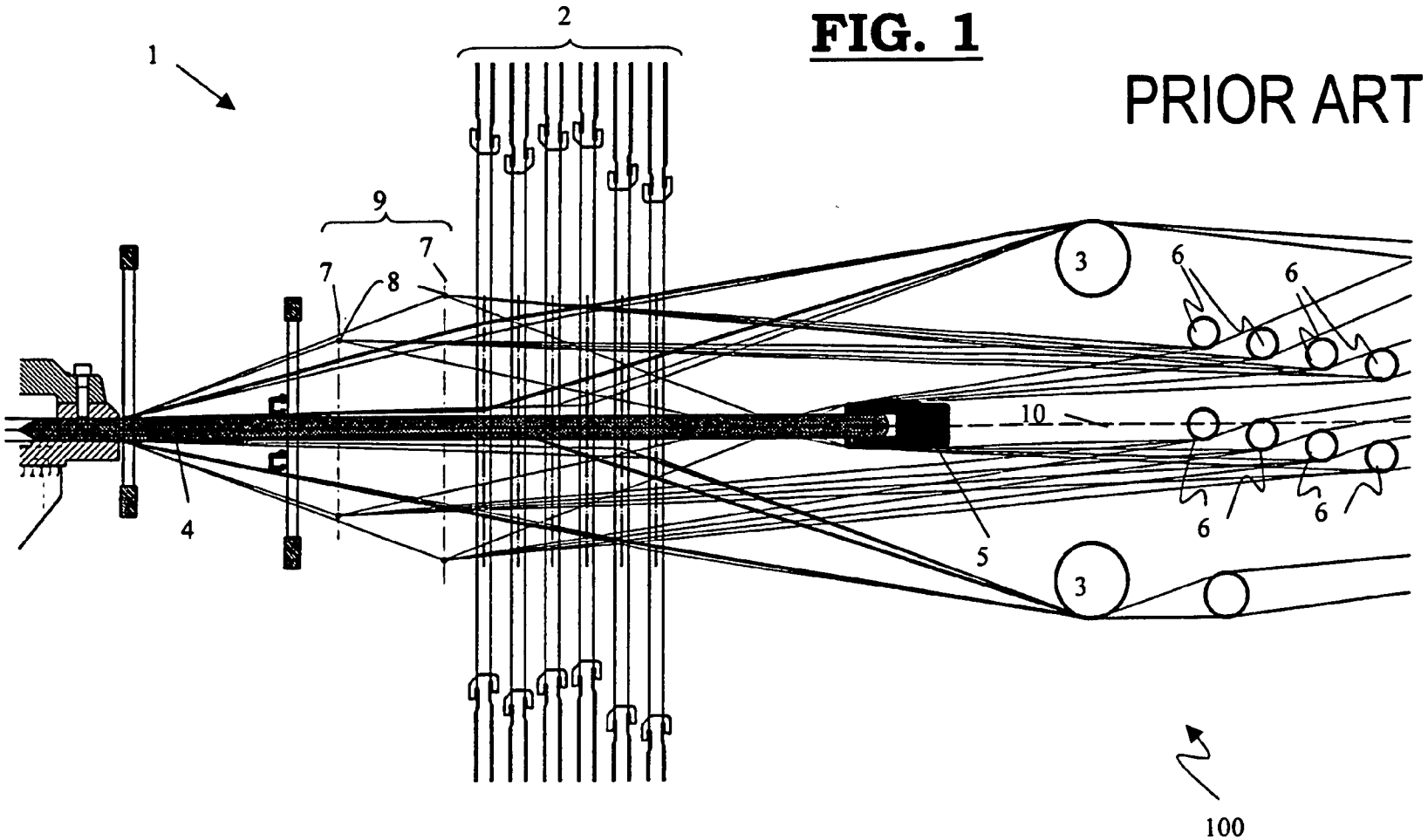
FIG. 1 PRIOR ART
FIG. 1 is representing a side view of the forming of a shed and a warp yarn supply of a double rapier face-to-face weaving machine with a lancet holder arrangement according to the state of the art.

In a weaving machine (1) for weaving pile fabrics consisting of weft yarns, backing warp yarns and pile warp yarns, for example a face-to-face weaving machine as represented in the FIGS. 1 through 6, the warp yarns are supplied from the rear (100) of the weaving machine (1). The warp yarns being brought into the required positions by the shed forming elements in order to realize the shed needed to form the pattern required for the backing and pile fabrics. The backing and pile warp yarns therefore are extending through one or several shed forming devices which have been provided with one or several heddle frames (2) moving up and down and containing a set of heddles (7), distributed across the width of the weaving machine (1). By means of these heddles (7), the backing warp yarns in the shed, i.e. the binding and tension warp yarns to form the backing fabric for the upper and lower fabric are brought into the positions required in accordance with the weave structure desired. Each heddle (7) is provided with a heddle eye (8) through which a backing warp yarn is conducted. The backing warp yarns are supplied from one or several backing warp yarn beams through separating bars (3) dividing the backing warp yarns among the upper and lower fabric.

The supply zone of the pile warp yarns is extending between a yarn supply and the heddles controlled by the shed-forming device.

In the weaving machine (1), furthermore, one or several spacers in the form of lancets (4, 4*a*, 4*b*) are provided, extending between the pile warp yarns. These lancets (4, 4*a*, 4*b*) are provided either to realize a constant pile height between two pile fabrics, or to determine a pile loop in one or several pile fabrics comprising loop piles. The lancets are clamped in one or several lancet holders (5, 5*a*, 5*b*). These lancet holders (5, 5*a*, 5*b*) are arranged between the yarn supply and the one or several shed forming devices.

In the double rapier face-to-face weaving machine according to the state of the art, as represented in FIG. 1, the lancet holder (5) is situated on the center line (10) of the shed. The backing warp yarns for the upper fabric are conducted above the lancet holder (5) to further extend through heddle eyes (8), whereas the backing warp yarns for the lower fabric are conducted below the lancet holder (5) before extending through the heddle eyes, because of which the backing warp yarns will not come in touch with the lancet holder (5) when the shed is formed. The pile warp yarns are supplied from a weaving creel and conducted through a separating grid through separating spindles (6) for the pile warp yarns, towards the heddle eyes (8) of the heddles (7) in a heddle frame (2) or in a harness arrangement (9) of a Jacquard machine.

The weaving machine as represented in FIG. 1 has quite a few drawbacks. These drawbacks have been mentioned above when the state of the art was discussed.

In order to remedy these drawbacks the said holders, for instance, the lancet holders (5*a*, 5*b*) in a weaving machine for weaving pile fabrics are arranged outside the said supply zone, such that the pile warp yarns may extend in the supply zone without any hindrance. In this manner the one or several lancet holders (5*a*, 5*b*) are removed from the central position in the shed. The lancets (4*a*, 4*b*) comprising at least three parts:

- a first part extending near one or several rulers, which have been provided to support the one or several, backing fabrics;
- a second part extending near one or several rapiers, which have been provided to insert the weft yarns;
- a third part extending near the said lancet holders (5*a*, 5*b*);

and the said third part being provided, bending off in order to be clamped in one or several lancet holders (5*a*, 5*b*) installed outside the supply zone. When the said three parts of the lancets (4*a*, 4*b*) are not situated substantially in one line, we speak about a forming lancet.

Figure 2:
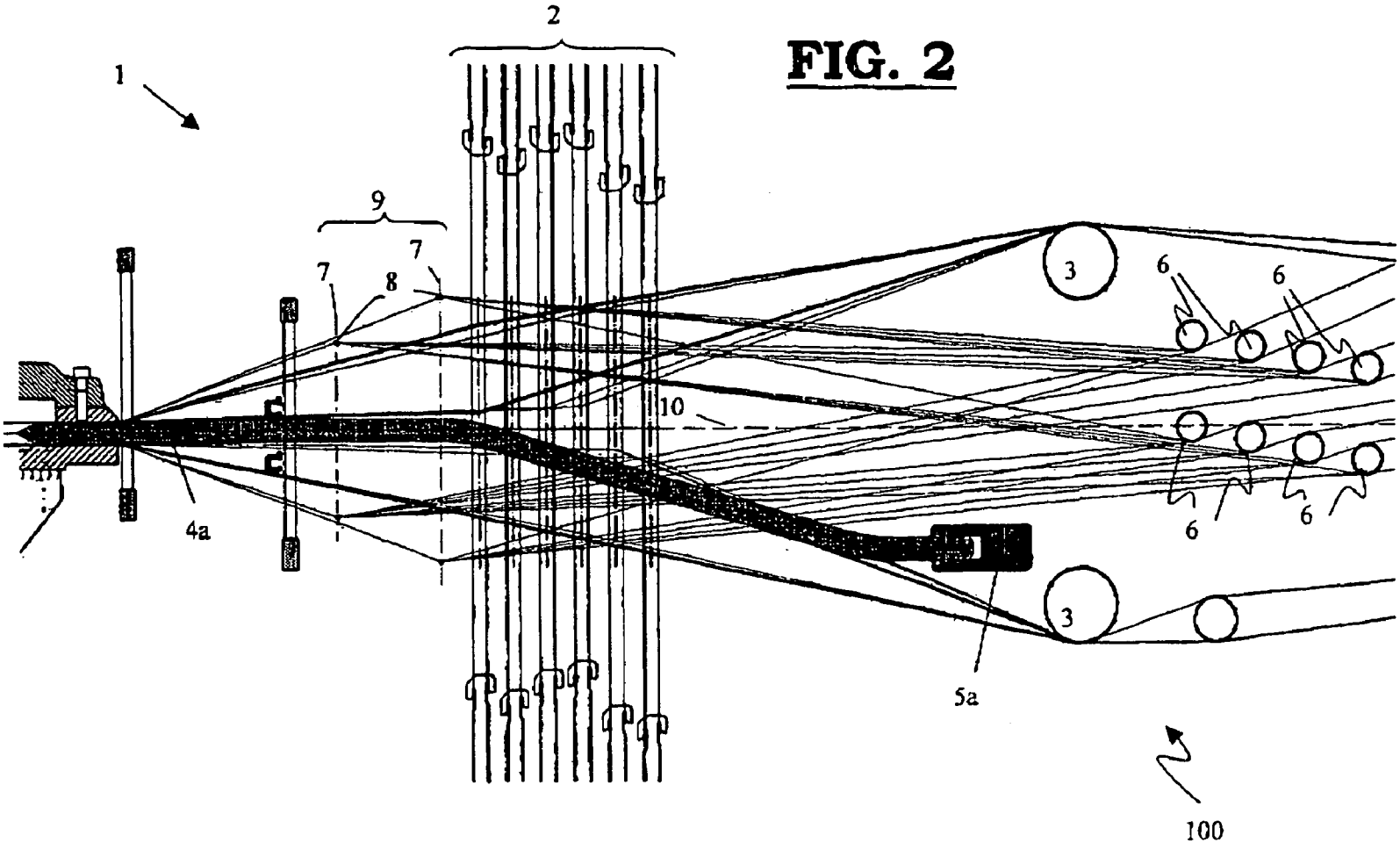
FIG. 2 is representing a side view of a first embodiment according to the invention of a double rapier face-to-face weaving machine.

In a face-to-face weaving machine with single lancets it is possible to operate with forming lancets, which all of them:

- are either bending off downwards, as represented in FIG. 2, so that the forming lancets (4*a*) are ending in a lancet holder (5*a*) being installed below the center line (10) of the shed;
- or are bending off upwards (not represented in the figure), so that the forming lancets are ending in a lancet holder being installed above the center line (10) of the shed.

a free passage being offered to the pile warp yarns in order to be supplied in the center without any risk of touching the lancet holder.

Figure 3:
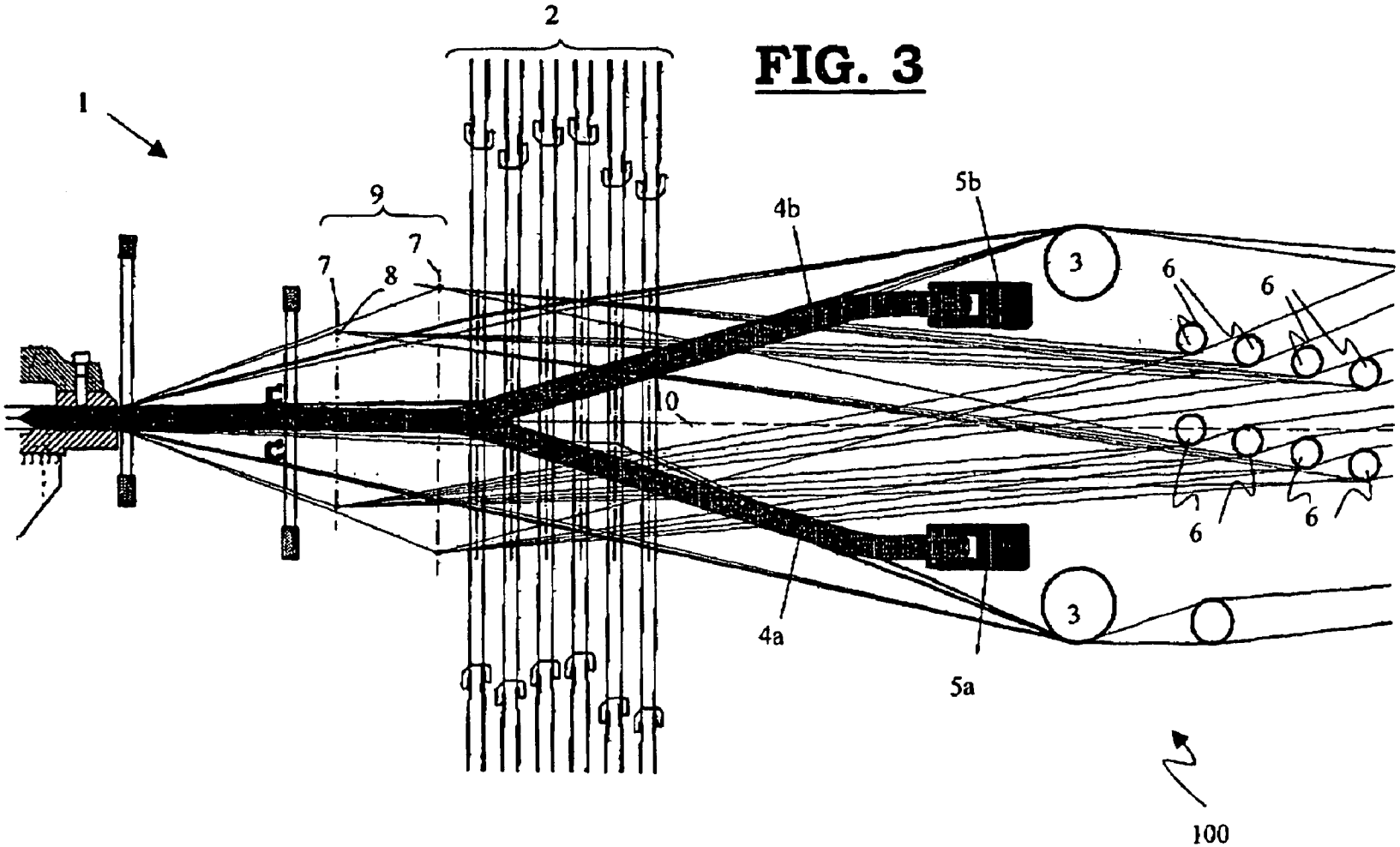
FIG. 3 is representing a side view of a second embodiment according to the invention of a double rapier face-to-face weaving machine.

In FIG. 3 an embodiment according to the invention is represented, where the lancets are split up in two groups: a first part of lancets (4*a*) are bending off downwards and a second part of lancets (4*b*) are bending off upwards so that the lancets (4*a*) of the first part are taken up in a lancet holder (5*a*) which is installed below the center line (10) of the shed, and the lancets (4*b*) of the second part are taken up in a lancet holder (5*b*) installed above the center line (10) of the shed.

Figure 4:
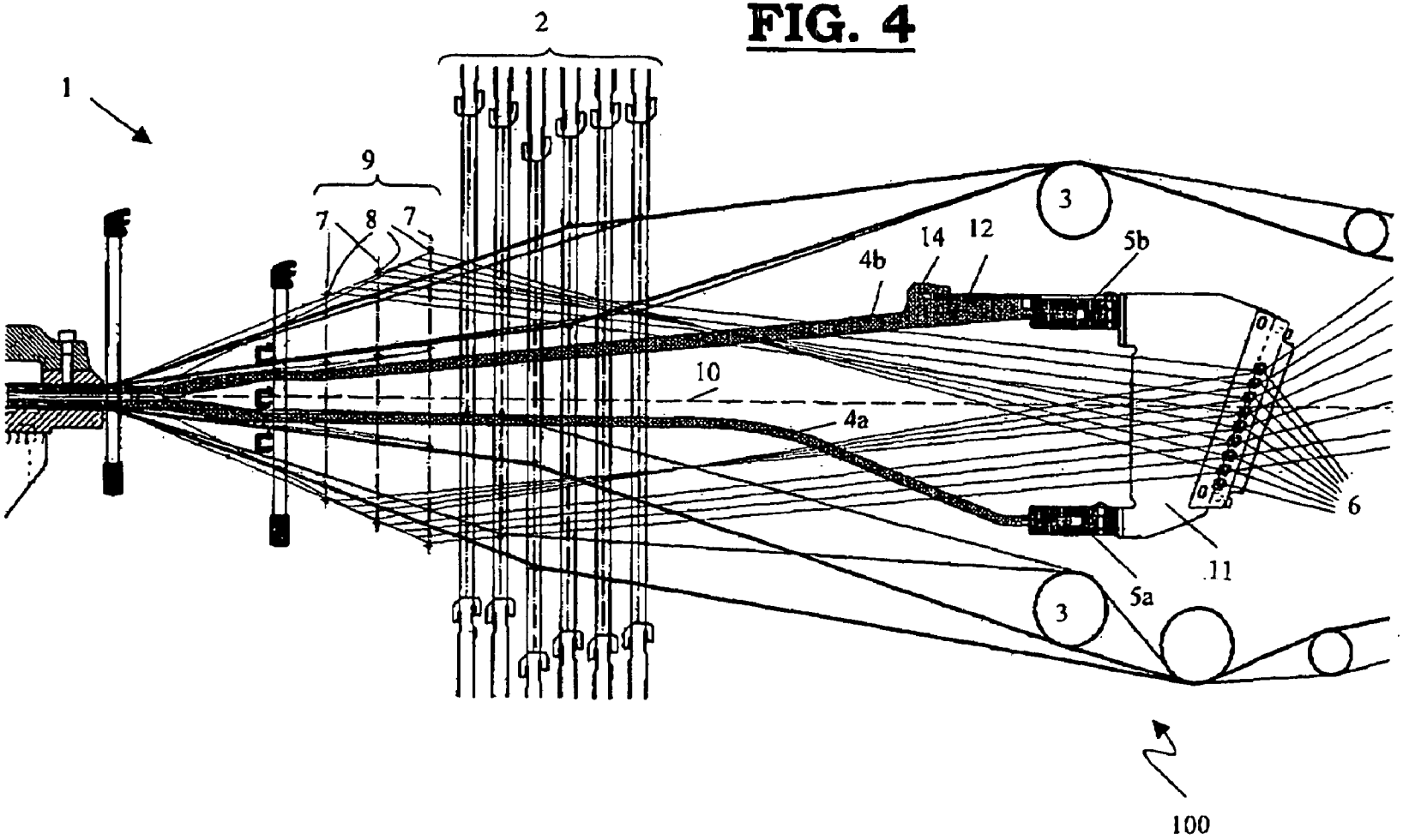
FIG. 4 is representing a side view of a first embodiment according to the invention of a three rapier face-to-face weaving machine provided with double lancets.
Figure 5:
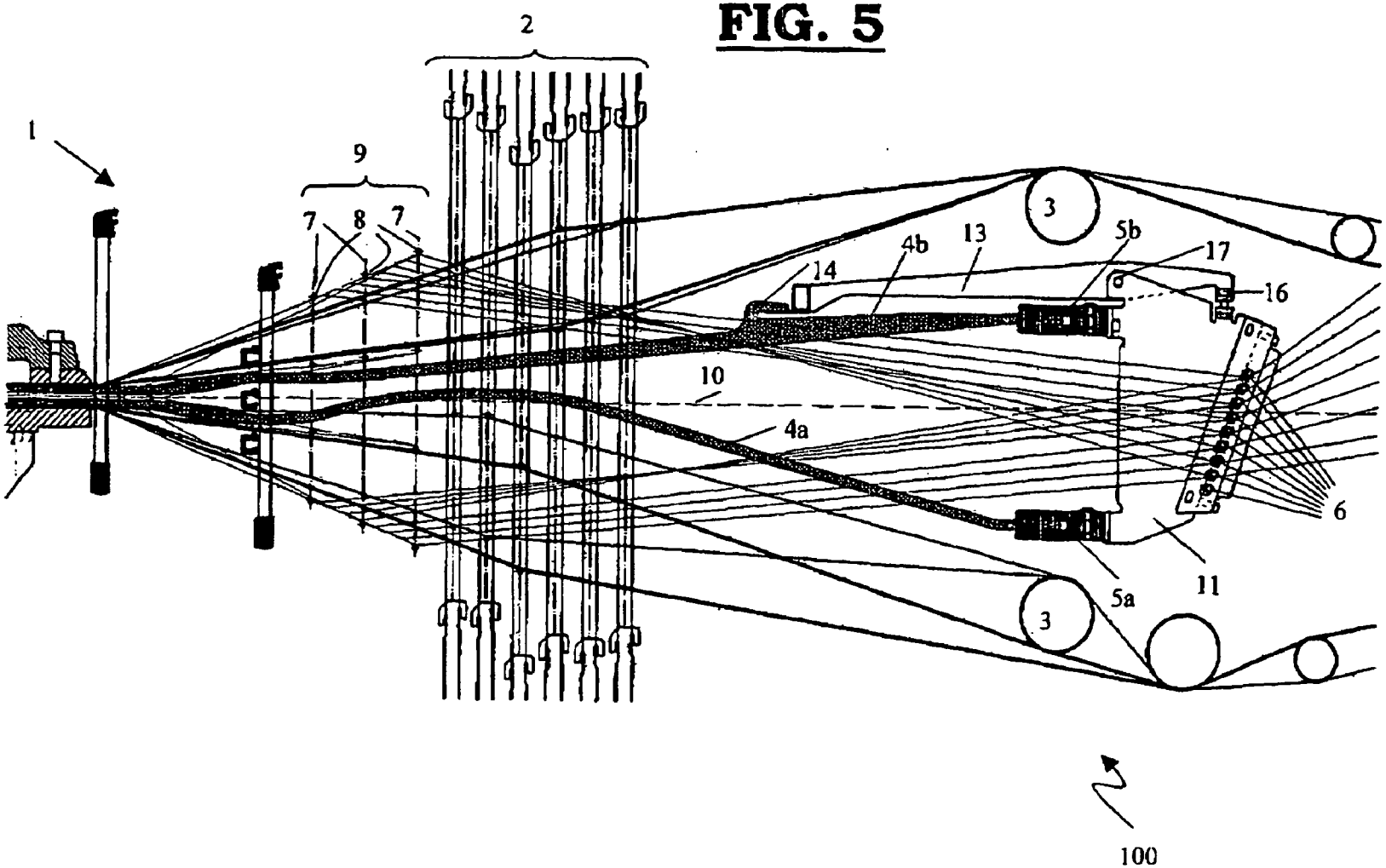
FIG. 5 is representing a side view of a second embodiment according to the invention of a three rapier face-to-face weaving machine provided with double lancets.

When for face-to-face-weaving a three rapier face-to-face weaving machine with double lancets, i.e. upper and lower lancets (4*b*, 4*a*) is used, such as represented in the FIGS. 4 and 5, with which fabrics with pile loops are produced face-to-face, then the upper spacers (4*b*) are bending off upwards in their third parts and the lower spacers are bending off downwards in their third parts.

In each of these cases, the lancet holders (5*a*, 5*b*) may be attached on both sides of the weaving machine (1), and the separating spindles (6) for the pile warp yarns may be attached to one or several lancet holders (5*a*, 5*b*) by means of their holders. Because the pile warp yarns are centrally supplied the separating spindles (6) for the pile warp yarns may be provided, if needed, with partitions (11) which, in turn, may be connected to one or several lancet holders (5*a*, 5*b*), as represented in the FIGS. 4 and 5. This will enable the use of lighter separating spindles (6) for the pile warp yarns and, in case of larger numbers of pile warp yarns, to prevent the pile warp yarns from getting in touch with several separating spindles (6) for the pile warp yarns. This means that the separating spindles (6) for the pile warp yarns may be installed, one below the other, in a more vertical position, so that the weaver will get a better access to the yarns in order to check the yarns or to repair them.

In a particular embodiment, as represented in the FIGS. 4 and 5, it is possible to provide one or several lancet holders (5*a*, 5*b*) with a device (12, 13) in order to increase the supporting surface of the lancets (4*a*, 4*b*) taken up in this surface, so that the lancets (4*a*, 4*b*) will not be tilted, or to a lesser extent, because of their own weight and because of the forces exerted on the lancets (4*a*, 4*b*) during the weaving process. In FIG. 4, the upper lancet holder (5*b*), equipped with a plate (12) extending towards the zone where the fabric is formed, and where the lancets (4*b*), taken up in this lancet holder (5*b*), are showing an additional tooth (14) that may be displaced across said plate (12), so that it will be possible for the lancet (4*b*) to be supported along a greater length and will be protected against buckling. As mentioned already, this design is particularly advantageous when used on a device with double lancets for face-to-face weaving of fabrics with pile loops, because in zones in the upper fabric, where there are no pile loops in the warp direction along the length, a lancet (4*a*, 4*b*) is extending in the fabric, the lancet (4*a*, 4*b*) may be forced to sag because of its own weight and under the influence of the load exerted by the warp yarns getting in touch with them.

As represented in FIG. 5, this supporting device for the lancets (4*a*, 4*b*) near the lancet holders (5*a*, 5*b*) may also be made adjustable as to the supporting force of the said lancets (4*a*, 4*b*), for instance, by tilting a plate (13), by means of an adjusting screw (16) and a tilting over point (17), so that this plate (13) will be pushing upwards the lancets (4*a*, 4*b*) or pushing them downwards respectively, depending on the direction in which the plate (13) is moving when operating the adjusting screw (16).

Figure 6:
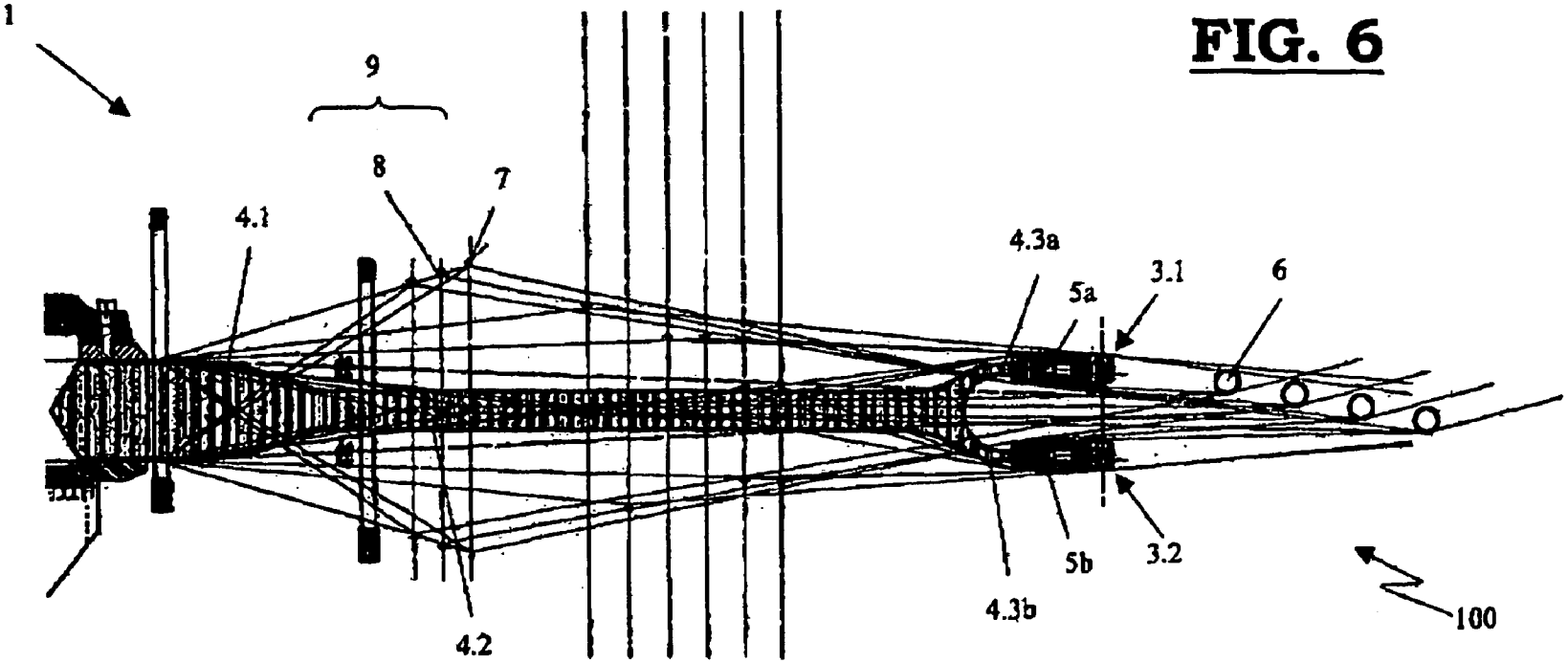
FIG. 6 is representing a side view of an embodiment according to the invention with a spoon lancet on a face-to-face weaving machine.

As represented in FIG. 6, the lancets (4), more particularly the spoon lancets, are comprising at least three parts:

- a top part or first part (4.1) extending near one or several rulers, provided to support one or several backing fabrics;
- a central part or second part (4.2) extending near one or several rapiers provided to insert weft yarns;
- a final part or third part (4.3) extending near the said lancet holders (5*a*, 5*b*), the height of the first part (4.1) here being greater than the height of the second part (4.2). So it will be possible for the lancet, near the top, to reach a height of more than 70 mm, more than 100 mm, or even more than 200 mm, whereas the height of the second part (4.2) is from 2 up to 5 times smaller, reaching a height of about 40 mm. Without this restriction in height, the rapiers should be far more apart, requiring a larger shed forming which would mean a strict limitation of the speed with which it will be possible to weave.

The final part (4.3) of the lancet is splitting up into two legs (4.3*a*, 4.3*b*), each leg being clamped by a different lancet holder. With the embodiment with split lancet holders (5*a*, 5*b*) it will become possible to incorporate these so-called spoon lancets in the two lancet holders (5*a*, 5*b*), and therefore to obtain a stable suspension and positioning of the lancets in the weaving machine (1) and, moreover it will be possible to realize a better supply of the pile warp yarns in the shed and to restrict the load exerted by the pile warp yarns on the harness.

This embodiment likewise enables us to completely eliminate the separating bars of the backing yarns, by having the backing warp yarns conducted around the rounded side of the edge (3.1) of the upper surface of the upper lancet holder (5*a*) directed towards the yarn supply, and around the rounded side of the edge (3.2) of the lower surface of the lower lancet holder (5*b*) directed towards the yarn supply.

In case several lancet holders (5*a*, 5*b*) are used, it will be possible to make the lancet holders (5*a*, 5*b*) adjustable as to their positions, for instance, to change over from one lancet step to another, in a driven manner, in order to be able to adjust different heights of the lancet, this in combination with changes to be made as to the height of the jaw as well as to modify the height of the loops. This may likewise be controlled in accordance with the pattern, however, under the understanding that moving the lancets (4*a*, 4*b*) backwards may be done without any problems (against the direction in which the fabric is formed). In order to move the lancets (4*a*, 4*b*) back forward, i.e. in the direction in which the fabric is formed, this should occur concurrent with the fabric formed, in other words, at a speed corresponding to the speed of the fabric. This may be controlled by means of the control system of the machine. Based on the number of shots inserted per unit of time and the actual number of shots per unit of length, the speed of the fabric and at the same time also the speed of the motion of the lancets may be calculated and controlled.

In case the weaving machine is a three rapier weaving machine with double lancets, the upper and the lower rapier are supported and conducted in their motion to insert the weft yarn by the backing warp yarns in order to form the upper and the lower backing fabric respectively. In order to support the central rapier by backing warp yarns, the heddle eyes (8) of the heddles (7) of the binding warp yarns of the lower backing fabric are crossing the lancets (4*a*, 4*b*) during the motions these heddles (7) have to perform in order to form the backing fabric. The collisions between the heddle eyes and the lancets occurring because of this are disadvantageous (as already described above). By shaping the lower lancets (4*a*) of the face-to-face weaving machine with three rapiers and double lancets near the shed forming means for the backing warp yarns of the backing fabrics, first bending off upwards above the center line of the shed, before bending off towards the holder for the spacers situated below the supply zone of the pile warp yarns, these disadvantages are remedied. In this manner it becomes possible again to position the heddles of the binding warp yarns of the lower backing fabric such, that these binding warp yarns may serve as a guide of the central rapier, without forcing the heddle eyes (8) to cross a lancet (4*a*, 4*b*) and because of this, to possibly collide with the lancets (4*a*, 4*b*) and without causing the lancets (4*a*, 4*b*), heddle eyes (8), backing and pile warp yarns to accumulate.

The invention claimed is:

1. Weaving machine for weaving pile fabrics consisting of weft yarns, backing warp yarns and pile warp yarns comprising:

one or several spacers (4, 4*a*, 4*b*) extending between the pile warp yarns and which are provided either to realize a constant pile height between two pile fabrics formed, or to determine the pile loop height in one or several pile fabrics comprising pile loops;

one or several holders (5, 5*a*, 5*b*) for clamping the spacers (4, 4*a*, 4*b*);

one or several shed forming devices, driving heddles (7) through which backing and/or pile warp yarns extend in order to position these pile warp yarns with respect to the weft yarns;

a yarn supply;

a zone for supplying pile warp yarns extending between the yarn supply and the heddles (7) controlled by the shed forming device, and one or several holders (5, 5*a*, 5*b*) being installed between the yarn supply and the one or several shed forming devices in order to clamp the spacers (4, 4*a*, 4*b*), characterized in that the said holders (5, 5*a*, 5*b*) have been installed outside the said supply zone, such that the pile warp yarns may be extending in the supply zone without hindrance.

2. Weaving machine according to claim 1, characterized in that the spacers (4, 4*a*, 4*b*) are comprising three parts:

a first part extending near one or several rulers provided to support one or several backing fabrics;

a second part extending near one or several rapiers provided to insert the weft yarns;

a third part extending near the said holders (5, 5*a*, 5*b*), the said third part is bending off, provided to be clamped in one or several holders installed outside the supply zone.

3. Weaving machine according to claim 1, characterized in that separating spindles (6) for the pile warp yarns are provided in the weaving machine to guide the pile warp yarns, these separating spindles (6) for the pile warp yarns being attached to one or several holders (5, 5*a*, 5*b*) of the spacers (4, 4*a*, 4*b*).

4. Weaving machine according to claim 3, characterized in that these separating spindles (6) for the pile warp yarns are provided with partitions (11) provided to be connected, each in turn, to one or several holders (5, 5*a*, 5*b*) of the spacers (4, 4*a*, 4*b*).

5. Weaving machine according to claim 1, characterized in that one or several holders (5, 5*a*, 5*b*) of the spacers (4, 4*a*, 4*b*) are provided with a device (12, 13) in order to increase the supporting surface of the spacers (4, 4*a*, 4*b*) taken up therein.

6. Weaving machine according to claim 5, characterized in that the device increasing the supporting surface of the spacers (4, 4*a*, 4*b*) taken up in the holders (5, 5*a*, 5*b*) is a flat plate (12) extending across the width of the fabric towards the zone where the fabric is formed, the spacers (4, 4*a*, 4*b*) taken up in the holders (5, 5*a*, 5*b*) are showing an additional tooth, being provided to slide in the said flat plate (12).

7. Weaving machine according to claim 5, characterized in that the said device (13) is provided to be adjustable as to the supporting position of the said spacers (5*a*, 5*b*).

8. Weaving machine according to claim 7, characterized in that an adjusting screw (16) and a tilting point (17) have been provided so that the said plate (13) may be tilted, so that this plate (13) will push the spacers (5*a*, 5*b*) upwards or downwards respectively, depending on the direction in which the plate (13) is moving when operating the adjusting screw (16).

9. Weaving machine according to claim 2, characterized in that the weaving machine is a face-to-face weaving machine with single spacers (4*a*, 4*b*), the holder of the spacers being installed above the supply zone and in that the third parts of the spacers are bending off upwards.

10. Weaving machine according to claim 2, characterized in that the weaving machine is a face-to-face weaving machine with single spacers (4*a*, 4*b*), the holder (5*a*) of the spacers (4*a*) being installed below the supply zone and in that the third parts of the spacers (4*a*) are bending off downwards.

11. Weaving machine according to claim 2, characterized in that the weaving machine is a face-to-face weaving machine with single spacers (4*a*, 4*b*), a first holder (5*b*) of the spacers (4*b*) being installed above the supply zone, and the third parts of a first part of the spacers (4*b*) are bending off upwards, and a second holder (5*a*) of the spacers (4*a*) being installed below the supply zone and in that the third parts of a second part of the spacers (4*a*) are bending off downwards.

12. Weaving machine according to claim 11, characterized in that alternately a first spacer (4*b*) of the said first part of the spacers (4*b*) bending off upwards and a second spacer (4*b*) of the said second part of the spacers (4*a*) bending off downwards are provided, bending off starting immediately outside the reach of the motion performed by the weaving reed.

13. Weaving machine according to claim 2, characterized in that the weaving machine is a face-to-face weaving machine with three rapiers and double spacers, i.e. upper and lower spacers (4*a*, 4*b*), the upper spacers (4*b*) bending off upwards in their third parts and the lower spacers (4*a*) bending off downwards in their third parts.

14. Weaving machine according to claim 13, characterized in that the lower spacers (4*a*), near the shed forming means of the backing warp yarns of the backing fabrics are first bending off upwards above the center line (10) of the shed, before bending off downwards towards the holder (5*a*) for the spacers (4*a*) being situated below the supply zone of the pile warp yarns.

15. Weaving machine according to claim 2, characterized in that the said spacers (4, 4*a*, 4*b*) are maintained in their operating positions by at least two holder elements (5*a*, 5*b*).

16. Weaving machine according to claim 15, characterized in that the said holder (5) is comprising an upper (5*a*) and a lower (5*b*) holder element, which are installed above and below the supply zone respectively.

17. Weaving machine according to claim 15, characterized in that the spacers (4) are comprising a third part (4.3) comprising at least two legs (4.3*a*, 4.3*b*), each leg being maintained in its operating position by a different holder element (5*a*, 5*b*).

18. Weaving machine according to claim 17, characterized in that the legs (4.3*a*, 4.3*b*) are extending substantially parallel to one another.

19. Weaving machine according to claim 15, characterized in that the spacers (4) are comprising a first part (4.1) and a second part (4.2) having a different height.

20. Weaving machine according to claim 18, characterized in that the second part (4.2) of the spacers (4) is extending between two different insertion levels of the weaving machine (1).

21. Weaving machine according to claim 1, characterized in that the edge (3.1) of the upper surface of the upper holder element (5*a*) directed towards the yarn supply and the edge (3.2) of the lower surface of the lower holder element (5*b*) directed towards the yarn supply have been rounded off.

22. Weaving machine according to claim 21, characterized in that the backing warp yarns are conducted across the rounded edges (3.1, 3.2) of the holder elements (5*a*, 5*b*).

23. Weaving machine according to claim 15, characterized in that the said weaving machine (1) is a face-to-face weaving machine.

24. Weaving machine according to claim 2, characterized in that the holders (5*a*, 5*b*) of the spacers (4*a*, 4*b*) are provided to be adjustable as to their positions.

25. Weaving machine according to claim 24, characterized in that the spacers (4*a*, 4*b*) are provided to be individually adjustable as to their positions.

26. Weaving machine according to claim 24, characterized in that the spacers (4*a*, 4*b*) are carried out in a stepped design, the spacers (4*a*, 4*b*) being displaced, in a driven manner, in the warp direction, passing from one step of the spacer (4*a*, 4*b*) to another.

27. Method for weaving pile fabrics consisting of weft yarns, backing warp yarns and pile warp yarns, characterized in that the method is carried out by means of a weaving machine (1) according to claim 26.

28. Spacer for a weaving machine according to claim 15, characterized in that the said spacer (4) has been provided to be maintained in its operational position by at least two holder elements (5*a*, 5*b*).

29. Spacer for a weaving machine according to claim 28, characterized in that the spacer (4) is comprising a third part (4.3) comprising at least two legs (4.3*a*, 4.3*b*), each leg being maintained in its operational position by a different holder element (5*a*, 5*b*).

30. Spacer for a weaving machine according to claim 29, characterized in that the legs (4.3*a*, 4.3*b*) are extending substantially parallel to one another.

31. Spacer for a weaving machine according to claim 28, characterized in that the spacer (4) is comprising a first part (4.1) and a second part (4.2) having a different height.

* * * * *